US012441580B2

(12) United States Patent
Hamazaki et al.

(10) Patent No.: US 12,441,580 B2
(45) Date of Patent: Oct. 14, 2025

(54) REEL MEMBER AND ADHESIVE FILM WINDING BODY

(71) Applicant: DEXERIALS CORPORATION, Tochigi (JP)

(72) Inventors: Kazunori Hamazaki, Tochigi (JP); Hiroyuki Nakamura, Tochigi (JP); Tomohisa Kawai, Tochigi (JP)

(73) Assignee: DEXERIALS CORPORATION, Tochigi (JP)

( * ) Notice: Subject to any disclaimer, the term of this patent is extended or adjusted under 35 U.S.C. 154(b) by 104 days.

(21) Appl. No.: 17/777,534

(22) PCT Filed: Nov. 18, 2020

(86) PCT No.: PCT/JP2020/042932
§ 371 (c)(1),
(2) Date: May 17, 2022

(87) PCT Pub. No.: WO2021/100741
PCT Pub. Date: May 27, 2021

(65) Prior Publication Data

US 2023/0339720 A1 Oct. 26, 2023

(30) Foreign Application Priority Data

Nov. 22, 2019 (JP) ..... 2019-211806

(51) Int. Cl.
*B65H 75/14* (2006.01)
*B65H 35/00* (2006.01)

(52) U.S. Cl.
CPC ..... *B65H 75/14* (2013.01); *B65H 75/145* (2013.01); *B65H 35/002* (2013.01); *B65H 2701/377* (2013.01)

(58) Field of Classification Search
CPC ..... B65H 75/14; B65H 75/145; B65H 75/00; B65H 75/02; B65H 75/08; B65H 75/12;
(Continued)

(56) References Cited

U.S. PATENT DOCUMENTS 851,366 A * 4/1907 Mossberg ..... B65H 75/14 242/612
962,654 A * 6/1910 Mossberg ..... B65H 75/14 242/118.6

(Continued)

FOREIGN PATENT DOCUMENTS

CN 101479176 A 7/2009
CN 102107803 A 6/2011

(Continued)

OTHER PUBLICATIONS

Nov. 16, 2023, Chinese Office Action issued for related CN Application No. 202080080149.9.

(Continued)

*Primary Examiner* — Anna M Momper
*Assistant Examiner* — Raveen J Dias
(74) *Attorney, Agent, or Firm* — Paratus Law Group, PLLC

(57) ABSTRACT

Provided is a reel member and an adhesive film winding body capable of suppressing sticking and blocking and preventing falling off. A real member includes: a winding core 3 around which an adhesive film 2 is to be wound; a pair of reel flanges 4 provided on both sides of the winding core 3; and a plurality of ribs 5 formed on an inner surface 4*a* of the reel flange 4, protruding from the inner surface 4*a*, and extending from the center side to the peripheral edge side of the reel flange 4, wherein in the rib 5, a rib top width W1 in (Continued)

contact with the adhesive film 2 is narrower than a rib base width W2 in contact with the inner surface 4*a* in cross-sectional view.

23 Claims, 10 Drawing Sheets

(58) Field of Classification Search
CPC ..... B65H 75/30; B65H 75/4402; B65H 75/4421; B65H 75/4428; B65H 75/4439; B65H 75/4442; B65H 2701/377; B65H 2301/41368; B65H 35/00; B65H 35/002; B65H 35/0026
See application file for complete search history.

(56) References Cited

U.S. PATENT DOCUMENTS 1,341,817 A * 6/1920 Mossberg ..... B65H 75/14 242/610.1
1,658,009 A * 1/1928 Seiffert ..... B65H 75/14 242/118.8
1,981,138 A * 11/1934 Arthur ..... B65H 75/14 206/399
1,981,139 A * 11/1934 Arthur ..... B65H 75/14 242/612
2,266,903 A * 12/1941 Pierce ..... B65H 75/2263 242/607
2,465,573 A * 3/1949 Hayner ..... B65H 75/14 242/118.7
2,985,402 A * 5/1961 Holahan, Jr. ..... A01K 89/015 242/118.4
3,099,414 A * 7/1963 Kuika ..... G11B 23/037 D8/358
3,462,097 A * 8/1969 Wilson ..... B65H 75/14 242/118.7
3,743,208 A * 7/1973 Schmitz ..... B65H 75/2263 242/118.8
3,940,086 A * 2/1976 Stoquelet ..... G02B 6/4457 242/118.6
3,966,139 A * 6/1976 Terpak ..... B65H 75/14 242/118.62
4,997,142 A 3/1991 Grant
5,474,254 A * 12/1995 Faulkner ..... B65H 75/14 242/614.1
6,003,807 A * 12/1999 Ripplinger ..... B65H 75/14 242/614.1
6,196,495 B1 * 3/2001 Hwang ..... B65H 75/2272 242/608.2
6,435,451 B1 * 8/2002 Leonhardt ..... G11B 23/037
6,874,726 B2 * 4/2005 Ripplinger ..... B65H 75/18 242/610.6
7,300,017 B1 * 11/2007 Sanda ..... B65H 75/14 242/610.5
9,637,346 B2 * 5/2017 Connell ..... B65H 75/145
11,420,843 B2 8/2022 Yamazaki
11,535,482 B1 * 12/2022 Swanson ..... B65H 75/14
2001/0035476 A1 * 11/2001 Ripplinger ..... B65H 75/14 242/614.1
2002/0079345 A1 * 6/2002 Shah ..... B65H 35/0026 225/51
2004/0124305 A1 * 7/2004 Huang ..... B65H 35/0073 242/588.6
2004/0226857 A1 * 11/2004 Wright ..... B65H 75/14 206/713
2009/0230233 A1 9/2009 Ochi et al.
2009/0283625 A1 * 11/2009 Ochi ..... B65H 75/14 242/614
2011/0139916 A1 6/2011 Ochi et al.
2011/0139922 A1 6/2011 Ochi et al.
2015/0197409 A1 * 7/2015 Caldieri ..... B65H 75/14 242/613
2015/0329311 A1 * 11/2015 Connell ..... B65H 75/14 242/118.61
2018/0118493 A1 * 5/2018 Murphy ..... B65H 23/08
2018/0118496 A1 * 5/2018 Murphy ..... B65H 23/08
2018/0118497 A1 * 5/2018 Murphy ..... B65H 16/04
2018/0118498 A1 * 5/2018 Murphy ..... B65H 35/0026
2018/0229961 A1 8/2018 Yamazaki
2019/0276266 A1 * 9/2019 Nilsson ..... B65H 75/2281

FOREIGN PATENT DOCUMENTS

CN 107848729 A 3/2018
JP S61-151967 U 9/1986
JP 2011-049576 A 3/2011
JP 2013-216436 A 10/2013
JP 2016-160027 A 9/2016
JP 2017-137188 A 8/2017
KR 10-2009-0018831 A 2/2009
TW 201125803 A1 8/2011
TW 201204621 A 2/2012
WO WO 2007/148593 A1 12/2007
WO WO-2011118503 A1 * 9/2011 ..... B65H 75/14
WO WO-2013008744 A1 * 1/2013 ..... B65H 75/14
WO WO-2013084797 A1 * 6/2013 ..... B65H 75/14
WO WO-2013151013 A1 * 10/2013 ..... B65H 75/14
WO WO-2014007114 A1 * 1/2014 ..... B65H 75/14

OTHER PUBLICATIONS

Aug. 23, 2023, Korean Office Action issued for related KR Application No. 10-2022-7016915.
May 31, 2024, Chinese Office Action issued for related CN Application No. 202080080149.9.
Feb. 28, 2024, Korean Office Action issued for related KR Application No. 10-2022-7016915.
Mar. 18, 2024, Taiwanese Office Action issued for related TW Application No. 109140212.
Sep. 11, 2024, Chinese Office Action issued for related CN Application No. 202080080149.9.

* cited by examiner

REEL MEMBER AND ADHESIVE FILM WINDING BODY

The present technology relates to a reel member around which a tape-like adhesive film is to be wound, and an adhesive film winding body formed by winding a tape-like adhesive film around a reel member. This application is a National Stage Patent Application of PCT International Patent Application No. PCT/JP2020/042932 filed on Nov. 18, 2020 under 35 U.S.C. § 371, which claims priority on the basis of Japanese patent application No. 2019-211806 filed in Japan on Nov. 22, 2019, the entire contents of which are incorporated herein by reference.

TECHNICAL FIELD

The present technology relates to a reel member around which a tape-like adhesive film is to be wound, and an adhesive film winding body formed by winding a tape-like adhesive film around a reel member. This application claims priority on the basis of Japanese patent application No. 2019-211806 filed in Japan on Nov. 22, 2019, which is incorporated herein by reference.

BACKGROUND ART

Conventionally, there has been known a mounting method for mounting electronic components on substrates by using adhesive films. For example, adhesive films are used to mount an electronic component such as a semiconductor component (IC chip) on a circuit board of an electronic device, or to connect a tab wire serving as an interconnector to a solar cell.

The adhesive film is constituted by forming an adhesive layer on a base film serving as a support. For example, as shown in FIG. 9, an adhesive film 50 is used in a form of a wound film 51 wound around a winding core 53 of a reel member 54 having a pair of reel flanges 52 on both sides of the winding core 53.

CITATION LIST

Patent Literature

Patent Document 1: Japanese Unexamined Patent Application Publication No. 2011-49576

Patent Document 2: Japanese Unexamined Patent Application Publication No. 2013-216436

SUMMARY OF INVENTION

Technical Problem

Unfortunately, replacement of the reel of the adhesive film 50 requires complicated works such as stopping the production line and pulling the adhesive film to the conveying roller, resulting in a large time loss in the connection process of the electronic component. Here, one approach for simplifying the reel replacement work of the adhesive film 50 and reducing the number of times of replacement is to elongate the adhesive film 50.

However, increasing the length of the adhesive film 50 wound around the winding core 53 of the reel member 54 will tighten the winding due to accumulation of the winding pressure in the vicinity of the winding core 53. In the adhesive film winding body, this tightened winding might cause protrusion of the binder resin serving as the adhesive layer from both sides of the base film, and the protruded binder resin might adhere to the reel flange 52 to cause blocking. This blocking would cause pull-out failure of the adhesive film in a connection device. This is because, as will be described later, a certain tension is generally applied to the adhesive film in the connecting device.

Such adhesive films are diversified, and increasing the film width will relatively increase the pressure applied to the side of the binder resin, which relatively increase the possibility of the occurrence of the above protrusion.

On the other hand, due to the recent demand for miniaturization of electronic devices, the mounting area is also narrowed, and accordingly, the width of the adhesive film is required to be narrowed. However, since a certain tension is applied during conveyance such as winding or pulling out of the adhesive film 50, narrowing the adhesive film 50 would relatively decrease the resistance to the tension. Therefore, there might be a case in which the adhesive layer cannot be kept parallel to the winding surface of the winding core 53 when the winding core 53 is wound or pulled out, the adhesive layer is inclined with respect to the winding core and easily oriented toward the flange surface side, and the adhesive layer adheres to the reel flange 52; this phenomena may cause a failure in the winding or pulling out process.

With regard to this, in the adhesive film winding body described in Patent Documents 1 and 2, a plurality of ribs are provided on the inner surface of the reel flange, in order to making it easy to avoid direct contact between the side part of the adhesive film and the reel flange, thereby preventing blocking. However, as shown in FIG. 10, forming ribs 55 on the inner surface of the reel flange 52 to prevent blocking will increase the width between the winding core 53 and the reel flange 52 by the height of the ribs 55, and when increased in length, the narrowed adhesive film 50 is liable to falling off between the reel flange 52 and the wound film 51 mainly at the time of winding.

FIGS. 10A and 10B are views for explaining the falling off of the adhesive film 50, wherein FIG. 10A indicates a state in which the adhesive film is properly pulled out without falling off, and FIG. 10B indicates a state in which the adhesive film has fallen off. When the adhesive film 50 is pulled out with a strong force, the adhesive film 50 on the outermost surface of the wound film 51 to be fed is biased from the wound film 51 toward one reel flange 52. Further pulling out the adhesive film 50 more strongly in this state would cause falling off of the adhesive film 50 between the one reel flange 52 and the wound film 51 (FIG. 10B). In the case of providing no ribs, the gap between the winding core 53 and the reel flange 52 becomes relatively small, so that falling off is less likely to occur, but there remains a concern of the blocking described above.

Therefore, it is an object of the present technology to provide a reel member and an adhesive film winding body having ribs capable of suppressing blocking and sticking and preventing falling off as with the case without ribs.

Solution to Problem

In order to solve the above-described problems, the reel member according to the present technology includes: a winding core around which an adhesive film is to be wound; a pair of reel flanges provided on both sides of the winding core; and a plurality of ribs formed on an inner surface of the reel flange, protruding from the inner surface, and extending from the center side to the peripheral edge side of the reel flange, wherein the rib has a top portion and a base portion and the width of the top portion of the rib in contact with the adhesive film is narrower than the width of the base portion of the rib in contact with the inner surface in cross-sectional view.

Further, the adhesive film winding body according to the present technology includes: a reel member comprising a winding core around which a tape-like adhesive film is to be wound, and a pair of reel flanges provided on both sides of the winding core; and a wound film formed by winding the adhesive film around the winding core, wherein the real member is the reel member described above.

Advantageous Effects of Invention

The present technology can suppress sticking and blocking and prevent falling off of an adhesive film.

MODE FOR CARRYING OUT THE INVENTION

Figure 1:
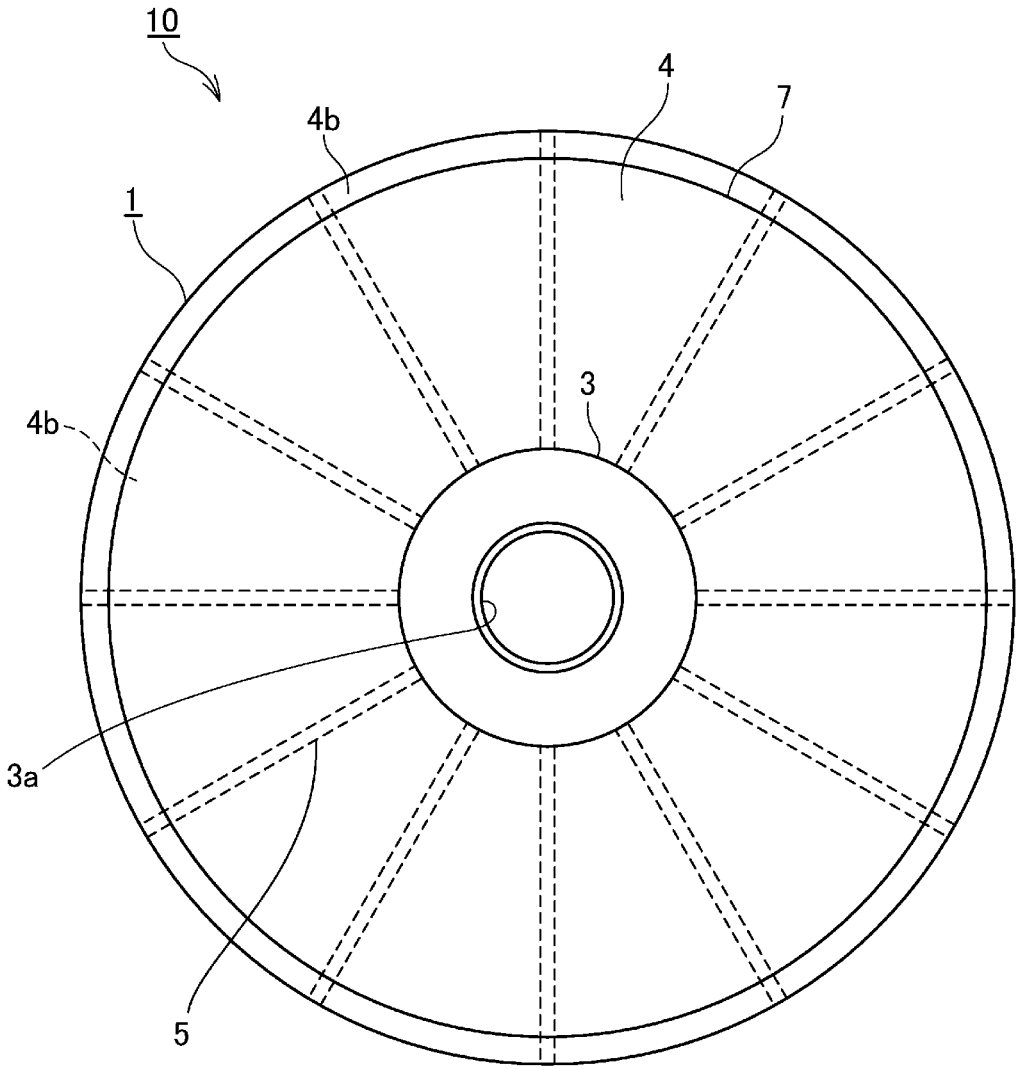
FIG. 1 is a side view illustrating an adhesive film winding body according to the present technology.

Hereinafter, a reel member and an adhesive film winding body according to the present technology will be described in detail with reference to the drawings. It should be noted that the present disclosure is not limited to the following embodiments and various modifications can be made without departing from the scope of the present technology. Moreover, the features illustrated in the drawings are shown schematically and are not intended to be drawn to scale. Actual dimensions should be determined in consideration of the following description. Furthermore, those skilled in the art will appreciate that dimensional relations and proportions may be different among the drawings in certain parts.

Reel Member

Figure 2:
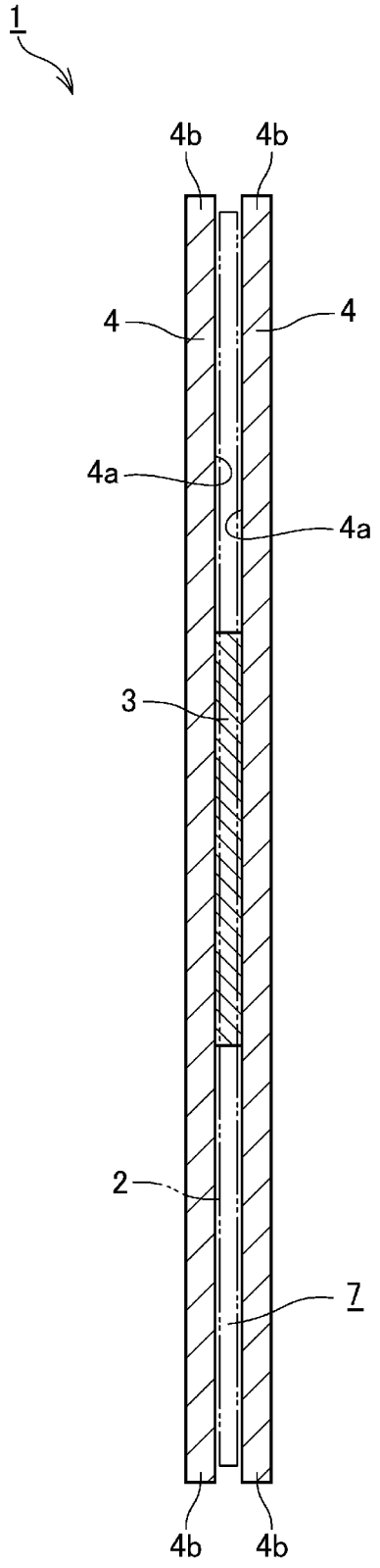
FIG. 2 is a cross-sectional view illustrating an adhesive film winding body according to the present technology.

FIGS. 1 and 2 show a reel member 1 according to the present technology. FIG. 1 is a front view illustrating an embodiment of the reel member 1, and FIG. 2 is a cross-sectional view of the reel member 1. The reel member 1 includes a winding core 3 around which a tape-like adhesive film 2 is to be wound, and a pair of reel flanges 4 provided on both sides of the winding core 3. The reel member 1 is further provided with a plurality of ribs 5 formed on an inner surface 4*a* of the reel flange 4, protruding from the inner surface 4*a* of the reel flange 4, and extending from the center side to the peripheral edge side of the reel flange 4.

Winding Core

The winding core 3 has a cylindrical shape and a width slightly larger than the width of the adhesive film 2 described later. Further, the winding core 3 is provided with, in the central portion thereof, an insertion hole 3*a* through which a rotating device (not shown) for rotating and driving the reel member 1 is to be inserted. The pair of reel flanges 4 are connected to both sides of the winding core 3, and the winding core 3 is rotated integrally with the reel flanges 4.

Figure 3:
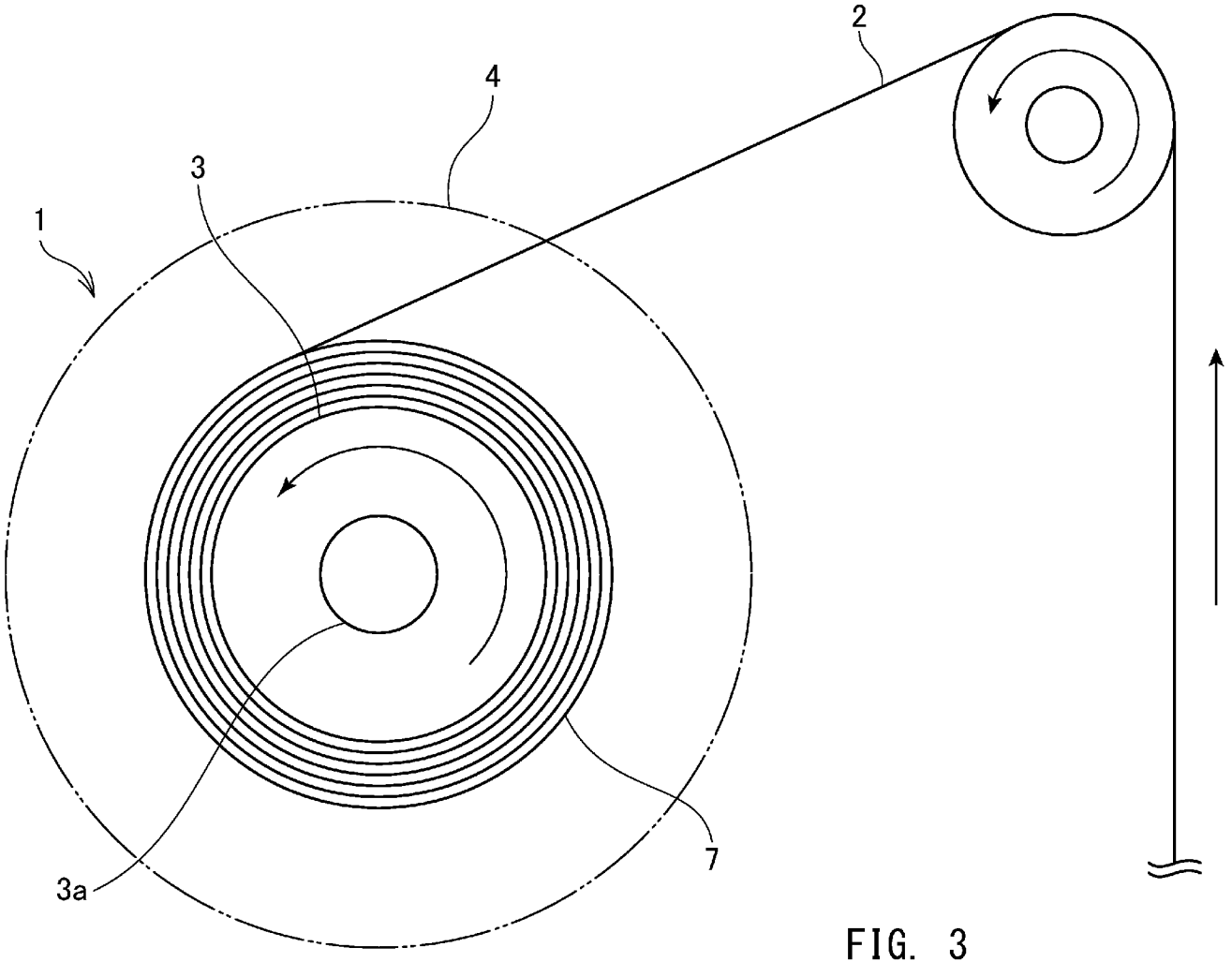
FIG. 3 is a cross-sectional view illustrating a step of winding an adhesive film around a winding core.

As shown in FIG. 3, the adhesive film 2 is wound multiple times around the winding core 3 on the peripheral surface thereof to form a wound film 7. Both sides of the wound film 7 are supported by the pair of reel flanges 4 to prevent winding collapse. The diameter of the winding core 3 may be appropriately designed, and is not particularly limited, but may be 40 to 160 mm as an example.

Reel Flange

The pair of reel flanges 4 support the wound film 7 in which the adhesive film 2 is wound multiple times around the winding core 3, and are formed in a disk shape with, for example, a plastic material. Further, it is preferable that the reel flange 4 is transparent to the extent that the ribs 5 described later is visible from the outside. Further, the surface of the reel flange 4 to be in contact with the wound film 7 may be subjected to an electrostatic treatment. The electrostatic treatment may be, for example, application of a compound such as polythiophene. The diameter of the reel flange 4 can be appropriately designed according to factors such as the diameter of the winding core 3 and the length of the adhesive film 2, and is not particularly limited, but may be set to 90 to 300 mm as an example.

Rib

As shown in FIG. 1, a plurality of ribs 5 extending from the center side to the peripheral edge side of the reel flange 4 are provided on the inner surface 4*a* of the reel flange 4. More specifically, the ribs 5 extend linearly from the joint portion of the inner surface 4*a* with the winding core 3 to a peripheral edge portion 4*b*, and 12 ribs are respectively provided at equal intervals of 30°, for example. The length of the rib 5 can be appropriately designed according to factors such as the diameter of the reel flange 4 and the diameter of the winding core 3. It is preferable that the length of the rib 5 reaches the winding core on the inner surface of the flange (the side on which the adhesive film is to be wound) in order to wind the adhesive film under the same conditions from the start to the end, and as an example, it can be set to (RIB LENGTH=FLANGE DIAMETER−WINDING CORE DIAMETER)/2. Ribs extending to the vicinity of the winding core will provide the nearly same effect. Further, as will be described later, the ribs may extend through the winding core to the inside of the winding core, and in this case, the length may be obtained by adding 2 to 45% of the diameter of the winding core to the above formula. The length of the rib 5 is determined by a combination of the diameters of the flange and the winding core, and the length of the rib 5 is less than the radius of the flange, and may be 25 to 135 mm as an example.

Reducing the number of the ribs 5 of the reel member 1 will reduce the contact area between the ribs 5 and the side of the wound film 7, which will be advantageous in preventing sticking at the time of winding and blocking at the time of pulling out; however, this also increases the interval between adjacent ribs 5 to increase the risk of falling off. Therefore, the number of the ribs 5 formed is preferably 6 or more, more preferably 12 or more. Increasing the number of the ribs 5 will increase the manufacturing difficulty but decrease the room for the adhesive film 2 to shift between the ribs 5 since the interval between the ribs 5 becomes narrow. Therefore, the number of the ribs 5 may be selected in consideration of composite factors such as the film width and length and the tendency of the binder resin to protrude. Design factors of the reel member 1 other than the number of the ribs may be selected in the same manner. Excessive number of ribs impairs the ease of manufacturing, so that the number of ribs is preferably 36 or less, and more preferably 24 or less.

Further, in order to uniformly reduce the risk of falling off over the whole circumference, it is preferable to provide the ribs 5 at equal intervals in the circumferential direction.

The upper limit of the height H of the rib 5 of the reel flange 4, in other words, the protruding amount from the inner surface 4*a* of the reel flange 4 to the top portion of the rib 5 in cross-sectional view is preferably less than 0.10 mm, more preferably 0.08 mm or less, and still more preferably 0.05 mm or less. The height H of the rib 5 of 0.10 mm or more will make the space between the both reel flanges 4 too large with respect to the width of the adhesive film 2, which induces falling off. The lower limit of the height H of the rib is preferably 0.01 mm or more, more preferably 0.015 mm or more, and still more preferably 0.02 mm or more. The height H of the rib 5 of less than 0.01 mm will make it difficult to suppress sticking and blocking of the adhesive layer.

Figure 4:
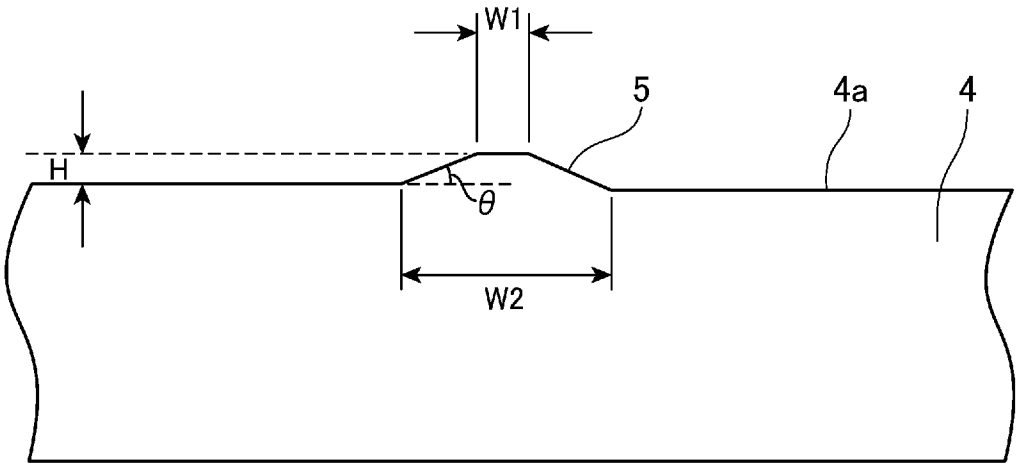
FIG. 4 is a cross-sectional view illustrating an example of the configuration of ribs.

As shown in FIG. 4, the rib 5 is a portion protruded from the inner surface 4*a* of the reel flange 4, and is formed in a linear shape from the center side to the peripheral edge side of the inner surface 4*a*. In cross-sectional view of the rib 5, the rib top width W1 to be in contact with the adhesive film 2 is narrower than the rib base width W2 in contact with the inner surface 4*a* of the reel flange 4. For example, the rib 5 is formed in a trapezoidal shape. As shown in FIG. 4, the rib 5 may be bilaterally symmetrical or may be bilaterally asymmetrical. In the longitudinal direction of the rib 5, a region having a bilaterally symmetrical shape and a region having a bilaterally asymmetrical shape may coexist. The ribs 5 may be arcuate or semicircular in cross-sectional view, but it is preferable for quality control to clarify the sides so as to make them recognizable. However, from the viewpoint of increasing the degree of freedom of design of the flange provided with the rib, it is preferable that the shape is designed freely.

The top portion of the rib 5 refers to a portion to be in contact with the wound film 7 in cross-sectional view, and the rib top width W1 refers to a distance in a direction perpendicular to the extending direction of the rib 5 at the top portion of the rib 5.

The top portion of the rib 5 is a portion capable of contacting with the wound film 7, and the rib top width W1 is preferably narrow in order to suppress sticking of the adhesive layer when the adhesive film 2 is wound on the reel member 1 and blocking when the adhesive film 2 is pulled out. Specifically, the upper limit of the rib top width W1 is preferably 0.80 mm or less, more preferably 0.60 mm or less, so as to effectively suppress sticking and blocking.

On the other hand, the top portion of the rib 5 is brought into contact with the side of the wound film 7 to prevent the adhesive film 2 from falling off from the wound film 7 when the adhesive film is pulled out. Therefore, if the rib top width W1 is too narrow, the risk of falling off increases accordingly. Therefore, the lower limit of the rib top width W1 is preferably 0.10 mm or more, more preferably 0.20 mm or more, so as to effectively suppress falling off.

The inclination angle θ of the rib 5 is not particularly limited as long as it is smaller than 90°, but can be suitably selected in the range of 2 to 88° in order to achieve excellent moldability and easy control of the contact area with the wound film 7. Smaller inclination angle of the rib 5 is closer to a flat surface, thus being considered to be suitable for preventing falling off. Specifically, in order for the inclination to be closer to a flat surface, the inclination angle is set to 45° or less, preferably 30° or less, more preferably 15° or less, and even more preferably 10° or less. However, an excessively small angle will induce sticking or blocking and may degrade, for example, the moldability of the rib 5 to affect the yield, so that, as described above, the angle is preferably 2° or more, more preferably 3° or more, and still more preferably 5° or more.

The base portion of the rib 5 refers to a portion between both end portions of the rib 5 in contact with the inner surface 4*a* of the reel flange 4 in cross-sectional view, and the rib base width W2 refers to a distance in the base portion of the rib 5 in a direction perpendicular to the extending direction of the rib 5. The rib base width W2 of the rib 5 is wider than the rib top width W1 and is defined by the height H of the rib 5 and the inclination angle θ. If the rib height H and the rib top width W1 are constant, the rib base width W2 of the rib 5 decreases as the inclination angle θ increases, and the rib base width W2 of the rib 5 increases as the inclination angle θ decreases. If the inclination angle θ of the rib 5 and the rib top width W1 are constant, the rib base width W2 of the rib 5 increases as the rib height H increases, and the rib base width W2 of the rib 5 decreases as the rib height H decreases.

Specifically, the rib base width W2 can be determined from the upper and lower limits of the rib top width W1 and the upper and lower limits of the inclination angle θ. As an example, under the condition of W1<W2, it is difficult to increase the number of ribs if the rib base width W2 is too wide, so that the upper limit of the rib base width W2 may be 5 mm or less, preferably 4 mm or less, more preferably 3 mm or less, and still more preferably 2.5 mm or less. On the other hand, if the rib base width W2 is too narrow, it becomes difficult to reproduce dimensional accuracy, so that the lower limit of the rib base width W2 is 0.6 mm or more, preferably 0.8 mm or more, more preferably 1 mm or more. It is preferable that all these conditions are satisfied in order to fully exhibit the effect of the present technology.

By optimally combining the factors of the rib height H, the rib top width W1, and the inclination angle θ of the rib 5 in the above-mentioned range in consideration of the composite factors such as the number of the ribs 5 formed, the width and length of the adhesive film 2, and the tendency of the binder resin to protrude, the reel member 1 can suppresses the sticking and blocking of the adhesive layer and can prevent the narrowed adhesive film 2 from falling into the space between the reel flange 4 and the winding core 3, thereby achieving an effect equivalent to that of a reel flange without ribs while providing the ribs 5. It should be noted that although the present technology tends to be effective in the adhesive film 2 having a narrowed width, the present technology is not limited to the applications with the narrowed adhesive film 2.

The rib 5 of the reel member 1 may have, for example, the rib height H of 0.02 mm, the rib top width W1 of 0.5 mm, the rib base width W2 of 0.9 mm, and the inclination angle θ of 5.7°, and the number of ribs may be 12. The number of ribs may be 24.

The rib 5 of the reel member 1 may have, for example, the rib height H of 0.05 mm, the rib top width W1 of 0.5 mm, the rib base width W2 of 1.5 mm, and the inclination angle θ of 5.7°, and the number of ribs may be 12. The number of ribs may be 24.

Here, as described above, the rib height H of the rib 5 of the reel flange 4 refers to the protruding amount from the inner surface 4*a* of the reel flange 4 to the top portion of the rib 5 in cross-sectional view. The rib height H of the rib 5 can be measured by removing the reel flange 4 from the winding core 3, placing the rib side of the flange on a glass plate or the like, fixing it with, e.g., a liquid adhesive if necessary, and measuring the length in contact with the top portion W1. Alternatively, the measurement can be performed by applying a releasable liquid adhesive, pressing a flat glass plate onto the adhesive, releasing the plate after curing, and then measuring the transfer thereof. Alternatively, the measurement can be performed by fixing the reel flange 4 with a resin or the like and polishing the measurement section by a section polishing machine. It should be noted that the rib top width W1 and rib base width W2 of the rib 5 and the inclination angle θ of the rib 5 can also be measure by applying the measuring method for measuring the rib height H of the rib 5. The height H of the rib 5 may be measured by a destructive inspection.

The reel flange 4 having such ribs 5 can be formed by a known manufacturing method such as injection molding, extrusion molding, or cutting.

Modified Example of Rib

Figure 5:
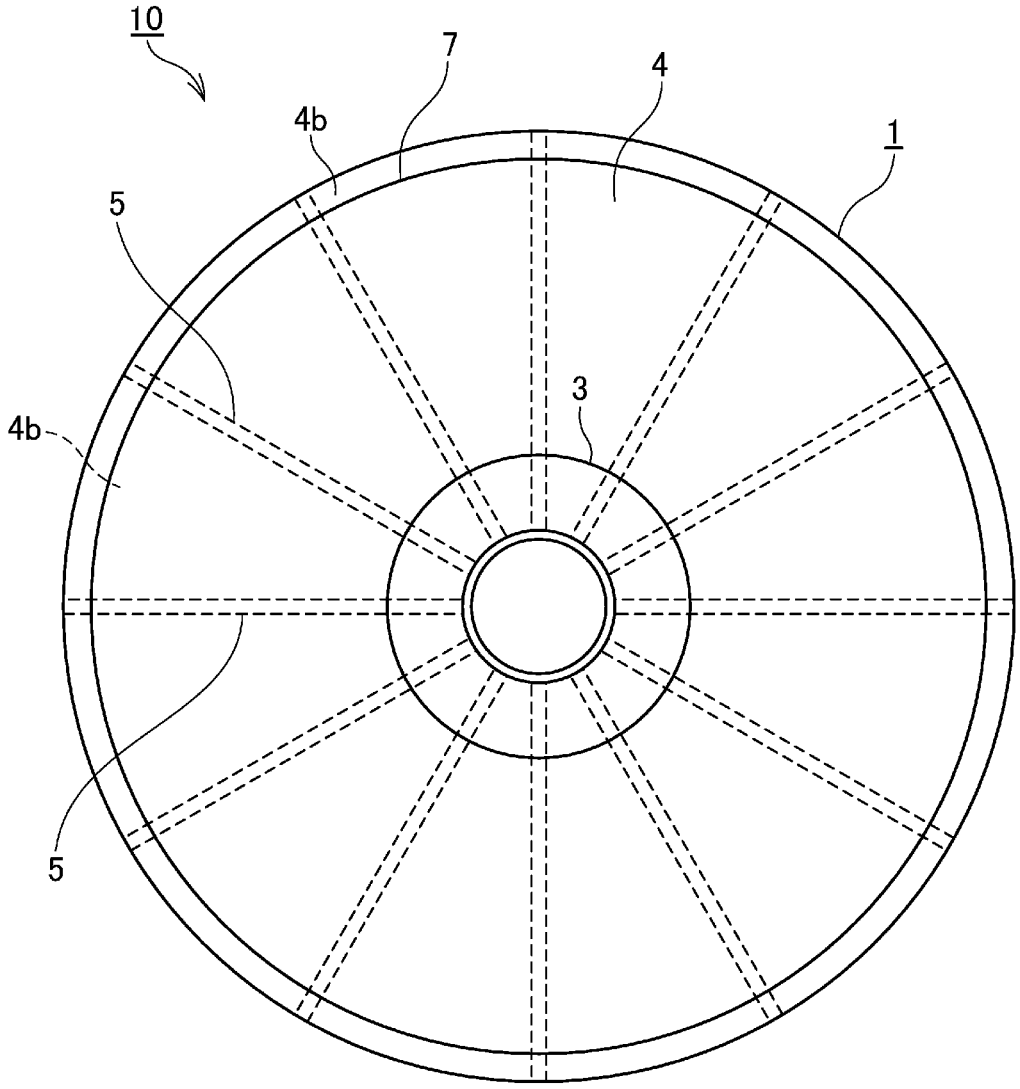
FIG. 5 is a side view illustrating a modified example of an adhesive film winding body according to the present technology.

As shown in FIG. 5, each rib 5 may extend to a position facing the winding core 3. This improves workability, reproducibility, and yield of the whole reel flange 4 in which the rib 5 is integrally formed or the whole reel member 1. In other words, when melted resin is poured into a mold at the time of molding the reel flange 4, or when the resin is subsequently taken out of the mold, the presence of a certain amount of resin as a rib extending to a position opposed to the winding core 3 increases workability and can stabilize the shape of the reel flange 4. In addition, the effect of eliminating the restriction of resin molding and improving the degree of freedom of mold design can be expected.

Figure 6:
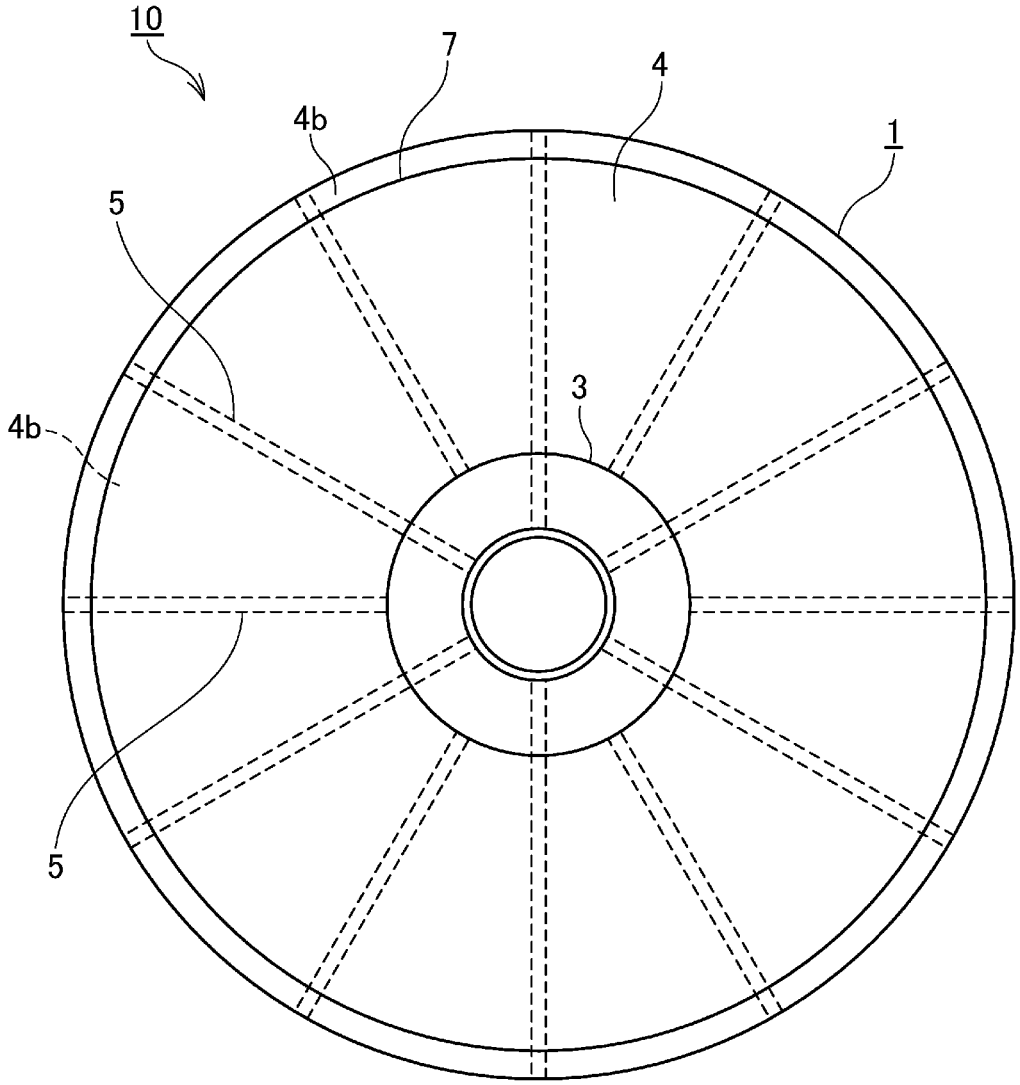
FIG. 6 is a side view illustrating a modified example of an adhesive film winding body according to the present technology.

All of the ribs 5 of the reel flange 4 do not need to extend to a position facing the winding core 3. Thus, the amount of resin for forming the reel flange 4 can be reduced. For example, as shown in FIG. 6, as every other ribs 5, there may be formed ribs 5 extending to a position facing the winding core 3 and ribs 5 extending only to a position capable of facing the wound film 7. Although such regularity is desirable from the viewpoint of quality inspection and reproducibility, such regularity is not necessary as long as a desired performance is achieved. Regardless of the presence or absence of regularity, the reel flange 4, in which the ribs 5 extending to a position facing the winding core 3 and the ribs 5 extending only to a position capable of facing the wound film 7 coexist, can be easily distinguished in appearance, thereby enhancing the distinguishability of the reel member 1. Therefore, as described above, the reel flange 4 may be transparent, and it is preferable that the reel flange 4 is transparent enough to make the rib 5 visible.

The rib 5 extending to a position facing the winding core 3 may have a width at a position facing the winding core 3 which is narrower than a width at a position capable of facing the wound film 7. This can reduce the amount of resin for forming the reel flange 4. On the other hand, the top width of the rib 5 extending to a position facing the winding core 3 may be wider than the top width at a position capable of facing the wound film 7. This will facilitate processing.

In addition, the rib 5 may be formed so that the height and cross-sectional shape of the rib extending to a position facing the winding core 3 are different from those of the position capable of facing the wound film 7. For example, the rib 5 extending to a position capable of facing the wound film 7 may have a bilaterally symmetrical shape, and the rib 5 extending to a position facing the winding core 3 may have a bilaterally asymmetrical shape, or vice versa. Further, the rib 5 extending only to a position capable of facing the wound film 7 may have a bilaterally symmetrical shape, and the rib 5 extending to a position facing the winding core 3 may have a bilaterally asymmetrical shape, or vice versa. This also improves the distinguishability with the appearance of the reel member 1.

Method of Manufacturing Reel Member

The winding core 3 and the pair of reel flanges 4 may be made of, for example, a thermoplastic resin. Examples of the thermoplastic resin include general-purpose resins, general-purpose engineering plastics, and super engineering plastics. The thermoplastic resin may be crystalline or amorphous. Examples of general-purpose resins include polyethylene, polypropylene, and polystyrene. Examples of general-purpose engineering plastics include polycarbonate and polyamide. Examples of super engineering plastics include polyimide and polyamide-imide. An amorphous resin is preferable from the viewpoint of dimension accuracy with good reproducibility. A general-purpose resin is preferable from the viewpoint of economical efficiency.

A method of manufacturing the reel member 1 includes a step of manufacturing molded products constituting the reel member 1, and a step of manufacturing the reel member 1 by combining molded products when the molded product constitutes a part of the reel member 1. Specifically, the reel member 1 can be manufactured by die molding.

Figure 7A:
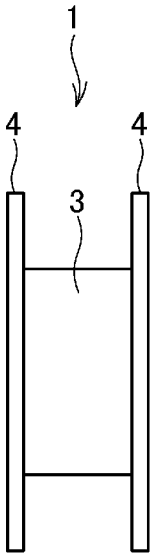
FIG. 7 is an explanatory view illustrating an outline of a method of manufacturing a reel member according to the present embodiment.

As shown in FIG. 7A, the whole reel member 1 may be integrally molded by using a die.

Figure 7B:
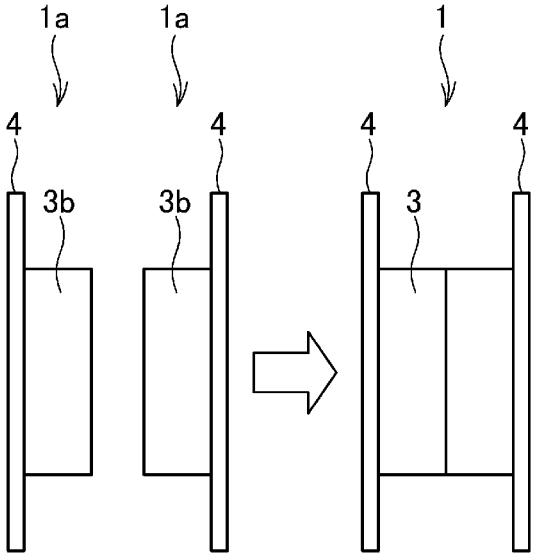

Alternatively, as shown in FIG. 7B, the reel member 1 may be manufactured by molding two molded products 1*a* and combining them. The molded product 1*a* includes a divided winding core part 3*b* on which an adhesive film can be wound, and a reel flange 4 integrally molded at one end part of the divided winding core part 3*b* in the rotational axis direction. The divided winding core part 3*b* has a shape in which the winding core 3 is equally divided into two parts in a direction perpendicular to the rotation axis. In other words, a plurality of divided winding core parts 3*b* connected in the rotational axis direction constitute the winding core 3. The method of combining the molded products 1*a* to each other is not particularly limited, and examples include ultrasonic welding and impulse welding.

Figure 7C:
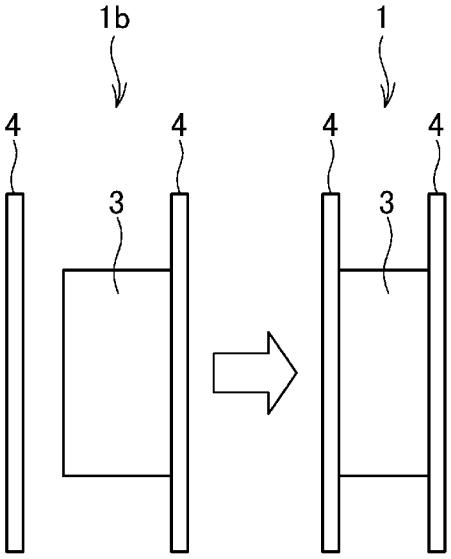

Further, as shown in FIG. 7C, the reel member 1 may be manufactured by molding a molded product 1*b* and the reel flange 4 and combining them. The molded product 1*b* has the winding core 3 and the reel flange 4 integrally molded at one end of the winding core 3 in the rotational axis direction.

Although the method of combining the reel flange 4 and the winding core 3 is not particularly limited, ultrasonic welding or impulse welding is preferable, but an adhesive tape (adhesive) or the like may be used.

Figure 7D:
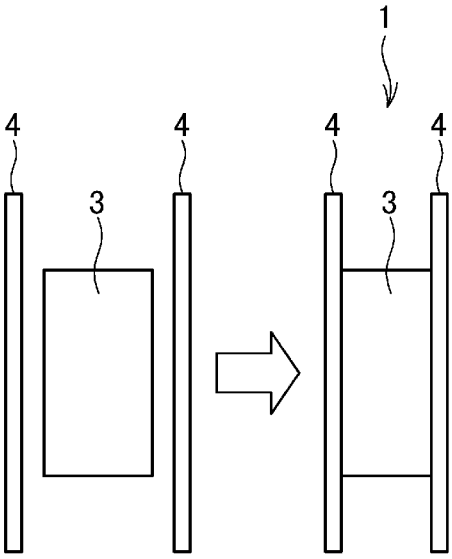

As shown in FIG. 7D, the reel member 1 may be manufactured by separately molding two reel flanges 4 and the winding core 3 and combining them. In this example, since the two reel flanges 4 and the winding core 3 are molded individually, the two reel flanges 4 and the winding core 3 can be molded with high accuracy. Further, the method for combining the two reel flanges 4 and the winding core 3 is not particularly limited, and examples include ultrasonic welding and impulse welding. As another method, molded products of the reel flange 4 and the winding core 3 may be formed as assemble parts and combined by using an adhesive or an adhesive film for assembling. This makes the winding core 3 seamless, thereby facilitating winding.

Adhesive Film Winding Body

An adhesive film winding body 10 includes the above-described reel member 1 and the wound film 7 formed by winding the adhesive film 2 around the winding core 3.

Adhesive Film

Figure 8:
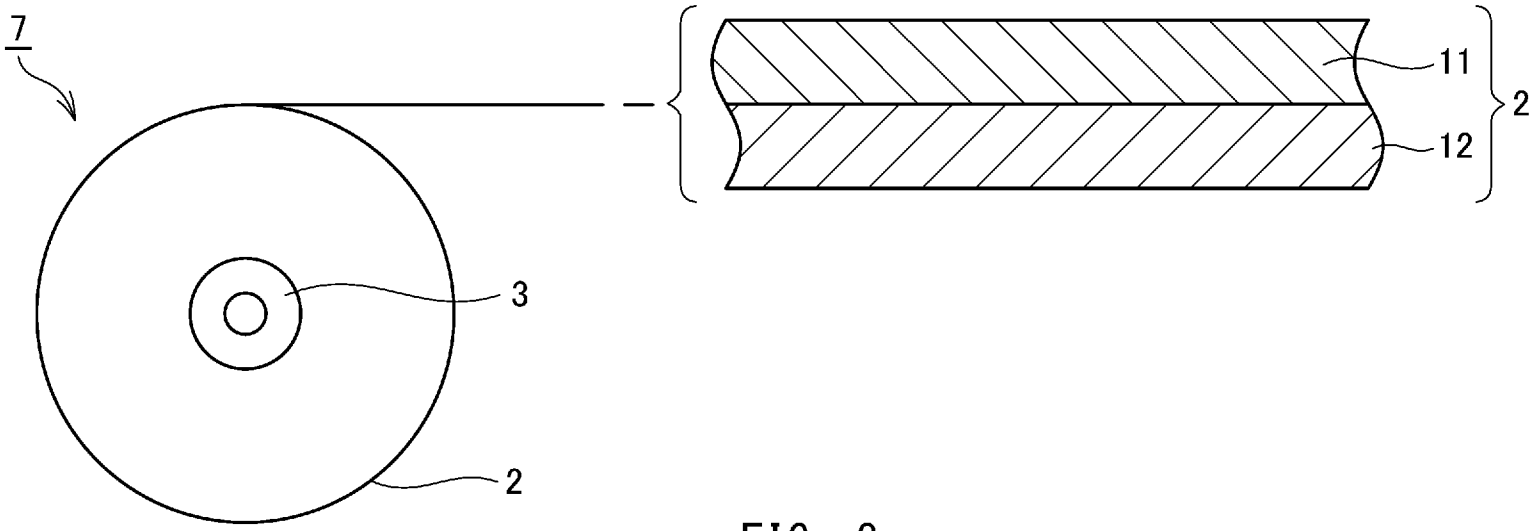
FIG. 8 is a cross-sectional view illustrating an example of the structure of an adhesive film.
Figure 9:
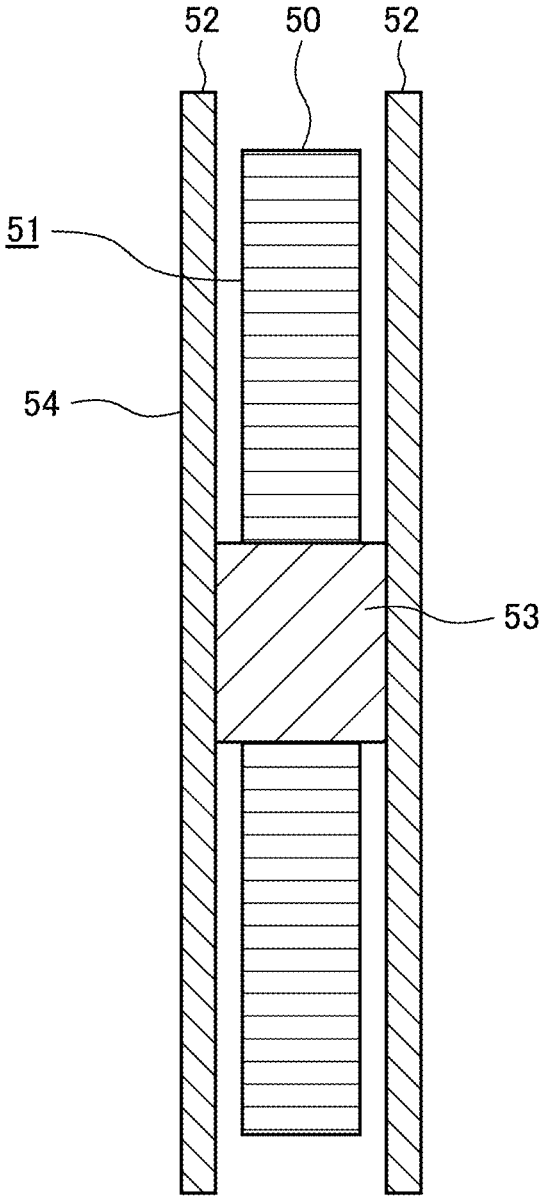
FIG. 9 PRIOR ART
FIG. 9 is a front view illustrating a conventional adhesive film winding body.
Figure 10B:
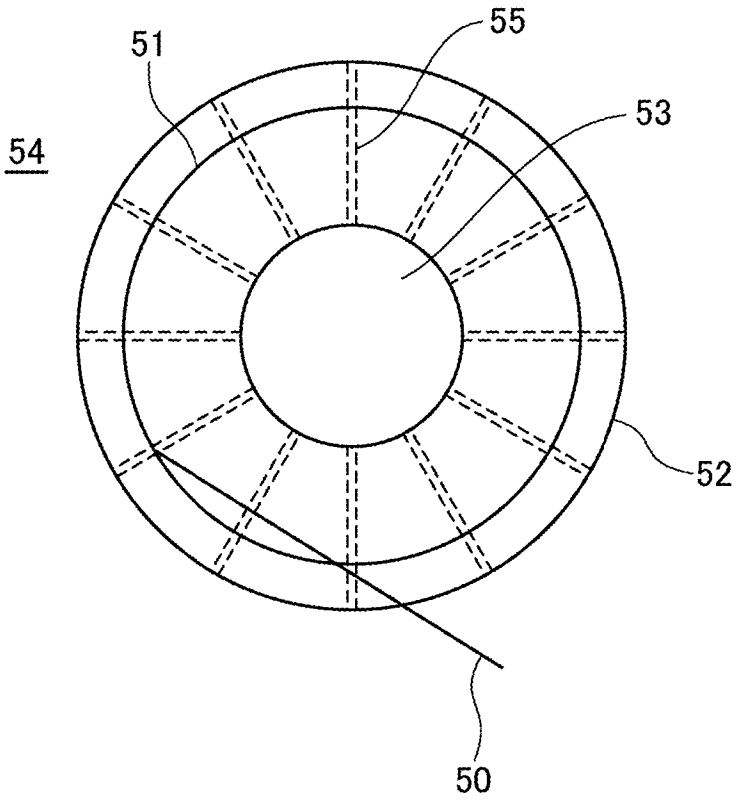
FIG. 10B PRIOR ART
FIGS. 10A and 10B are views for explaining the falling off of the adhesive film, wherein FIG. 10A indicates a state in which the adhesive film is properly pulled out without falling off, and FIG. 10B indicates a state in which the adhesive film has fallen off.
Figure 10A:
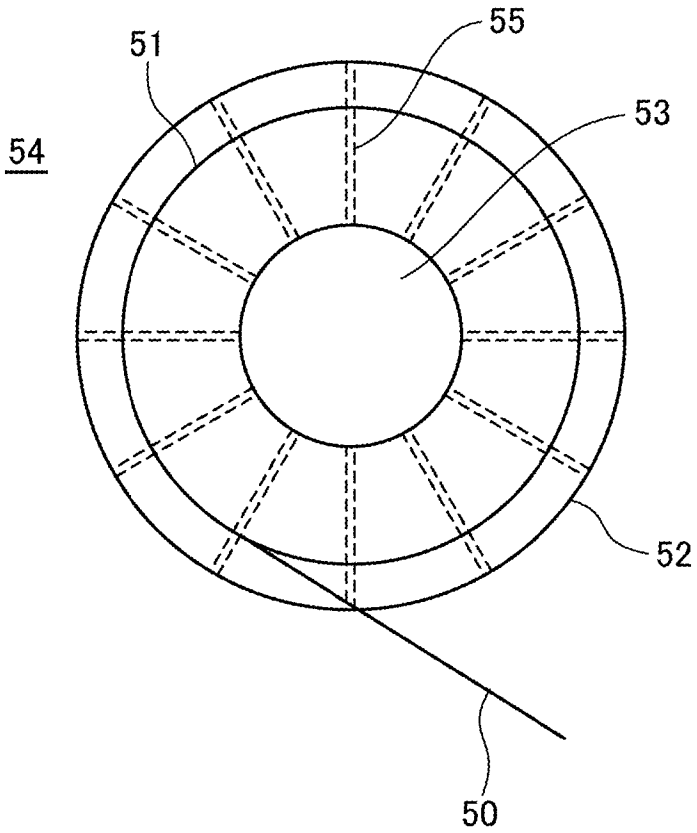
FIG. 10A PRIOR ART

As shown in FIG. 8, the adhesive film 2 to be wound around the winding core 3 includes a base film 11 and an adhesive layer 12 made of an insulating binder supported by the base film 11.

The length of the adhesive film 2 is not particularly limited, but the lower limit of the length of the adhesive film 2 to form an adhesive film winding body product may be m or more, preferably 10 m or more, and more preferably 50 m or more. However, longer film length increases the pressure applied to the adhesive film 2 in the vicinity of the winding core due to tightening of the winding, which increases the risk of occurrence of blocking due to protrusion of the adhesive layer. Therefore, the upper limit of the length may preferably be 500 m or less, 400 m or less, or 300 m or less.

Although the width of the adhesive film 2 is not particularly limited, the mounting area is also narrowed due to the recent demand for miniaturization of electronic devices, and accordingly, the width of the adhesive film is required to be narrowed. In accordance with such narrowing, the adhesive film 2 may preferably have an upper limit width of, for example, 0.6 mm or less, 0.5 mm or less, or 0.4 mm or less, and a lower limit width of 0.1 mm or more.

An example of the narrowed and elongated adhesive film 2 has a width of 0.6 mm and a length of 350 m. As a method of manufacturing an elongated adhesive film, for example, a plurality of short adhesive films (for example, about 100 m) may be prepared and then connected. The winding core 3 and the adhesive film 2 may be fixed by using a lead and a connecting tape (not shown).

The base film 11 is a support film shaped into a tape shape to support the adhesive layer 12. The base film 11 may be made of a material such as PET (polyethylene terephthalate), OPP (oriented polypropylene), PMP (poly-4-methylpentene-1), and PTFE (polytetrafluoroethylene). Further, as the base film 11, a material in which at least the surface on the side of the adhesive layer 12 is release treated with silicone resin can be suitably used.

Although the present embodiment assumes the adhesive film 2 in which the base film 11 and the adhesive layer 12 are separable, the present technology is also applicable to an adhesive film in which the adhesive layer is not separable from the base film. This is because, in such an adhesive film, for example, if the adhesive film has a narrow width, the problem of falling off occurs similarly. Therefore, the adhesive layer may be a layer exhibiting only tackiness.

The thickness of the base film 11 is not particularly limited. The lower limit of the thickness of the base film 11 may be practically 3 μm or more, preferably 10 μm or more, more preferably 25 μm or more, and still more preferably 38 μm or more for stable separation. The upper limit of the thickness of the base film 11 is preferably 200 μm or less, more preferably 100 μm or less, and still more preferably 75 μm or less because there is a concern that the adhesive layer 12 will be excessively pressurized if it is too thick. The thickness may be 50 μm or less.

On the other hand, the insulating binder (resin composition) for forming the adhesive layer 12 may be a known insulating binder, which may be appropriately selected according to the use of the adhesive film 2 and the presence or absence of a filler, among other factors, and may be formed from a thermoplastic resin composition, a high-viscosity adhesive resin composition, or a curable resin composition. For example, when the adhesive film 2 is used as an adhesive material for mounting an electronic component or the like, it can be the same as the resin composition for forming an insulating resin layer or the like described in WO 2018/074318 A1. A plurality of insulating resin layers may be laminated. In addition, in a laminate in which a plurality of insulating resin layers are laminated, it is not necessary that all the layers have same compounds.

The polymerization initiator of the curable resin composition may be a thermal polymerization initiator, a photopolymerization initiator, or a combination of these. In an example, a thermal cationic polymerization initiator is used as the thermal polymerization initiator, an epoxy resin is used as a thermal polymerizable compound, a photoradical polymerization initiator is used as the photopolymerization initiator, and an acrylate compound is used as a photopolymerizable compound. A thermal anionic polymerization initiator may be used as the thermal polymerization initiator. As the thermal anionic polymerization initiator, it is preferable to use a microcapsule type latent curing agent having an imidazole modified material as a core coated with polyurethane.

The melt viscosity at a predetermined temperature of the entire adhesive layer formed of the curable resin composition and the minimum melt viscosity thereof are not particularly limited, and may be, for example, similar to, but not limited to, the insulating resin layer of WO 2018/074318 A1. It is considered that the melt viscosity is a dominant factor for the occurrence of protrusion at storage temperature and environmental temperature during use, among others. If the minimum melt viscosity is too high, there will be concerns about pushing and flow when using the film under a pressure, so it may be adjusted according to the target. This minimum melt viscosity can be measured by using, for example, a rotary rheometer (manufactured by TA Instrument) by holding it constant at a measurement pressure of 5 g and using a measuring plate having a diameter of 8 mm, specifically, under the conditions of a temperature range of 30 to 200° C., a temperature rising rate of 10° C./min, a measurement frequency of 10 Hz, and a load variation with respect to the measuring plate of 5 g. The melt viscosity at a predetermined temperature can be measured in the same manner as the minimum melt viscosity by fixing the temperature. The melt viscosity may be measured by tensile measurement by TMA (Thermomechanical Analysis). The minimum melt viscosity can be adjusted by changing the type and amount of the melt viscosity adjusting agent and the thixotropic agent, or the adjustment conditions of the resin composition.

Depending on the usage of the adhesive film 2, the insulating binder may contain a filler such as an organic filler, an inorganic filler, or a filler obtained by combining these fillers (organic-inorganic mixed filler), for the purpose of imparting conductivity or other functions such as a viscosity modifier, a thixotropic agent, a polymerization initiator, a coupling agent, and a flame retardant, among others. The filler may be, for example, a conductive filler for conducting electricity, an insulating filler used as a gap spacer, a filler for an optical purpose such as light scattering or matting, and a filler used for a coloring purpose such as a pigment, and may be suitably adjusted according to the purpose of use. The use of the filler is not limited, and there are a wide variety of known fillers for each use, which will not be described here. The filler is not limited to one kind, and a plurality of kinds of fillers may be mixed. The size (average particle diameter) of the filler is not particularly limited.

Method of Manufacturing Adhesive Film

The adhesive film 2 can be manufactured by mixing each binder resin component described above and the filler contained as necessary to prepare a binder resin composition, applying the binder resin composition on the base film 11 to form a film, and drying the film. The filler may be provided after the binder resin component is film-formed on the base film 11. The adhesive film 2 may further be provided with a release film on a surface opposite to the base film 11.

As shown in FIG. 3, the adhesive film 2 is wound multiple times around the winding core 3 of the reel member 1 while being guided by a guide roller, thereby forming the wound film 7. Both sides of the wound film 7 are supported by a pair of reel flanges 4 to prevent winding collapse. Thus, the adhesive film winding body 10 is formed.

In the reel member 1, the rib top width W1 in contact with the adhesive film 2 is narrower than the rib base width W2 in contact with the inner surface 4*a* of the reel flange 4 in cross-sectional view of the rib 5. Thus, the reel member 1 can prevent the adhesive layer 12 from sticking by narrowing the adhesive film 2. Also, when the adhesive film 2 is pulled out, blocking and falling off can be suppressed.

As described above, the rib height H of the rib 5 of the reel member 1 is preferably greater than 0.01 mm and less than 0.10 mm. The rib top width W1 is preferably 0.10 mm or more and 0.80 mm or less. The inclination angle θ of the rib 5 is preferably 2° or more and 88° or less, and when it is set to 45° or less, the shape of the rib 5 is gently raised, and the inner surface 4*a* of the reel flange 4 can be brought closer to a flat surface.

In this way, by optimally combining the factors of the rib height H, the rib top width W1, and the inclination angle θ of the rib 5 in the above-mentioned range in consideration of the composite factors such as the number of ribs 5 formed, the width and length of the adhesive film 2, and the tendency of the binder resin to protrude, the reel member 1 can suppresses the sticking and blocking of the adhesive layer and can prevent the film, even in the case of the narrowed contact, from falling into the space between the two reel flanges 4, thereby achieving an effect equivalent to that of a reel flange without ribs while providing the ribs 5.

Tack of Adhesive Layer

It should be noted that the dimensional design of the ribs 5 for preventing the adhesive layer 12 from sticking or falling off in the adhesive film winding body 10 can also be affected by the adhesive force (tack) of the adhesive layer 12. In other words, when the tack is large, the displacement of the adhesive film 2 hardly occurs in the wound film 7, and which expands the allowable range of the rib height H for suppressing falling off. However, when the tack is large, the risk of sticking or blocking caused by the contact of the adhesive layer 12 with the rib is increased, which narrows the allowable ranges of the rib top width W1 and the number of ribs.

On the contrary, when the tack is small, the adhesive film 2 tends to easily slip in the wound film 7, which narrows the allowable range of the rib height H in order to suppress falling off. However, when the tack is small, the risk of sticking or blocking caused by the contact of the adhesive layer 12 with the rib is reduced, which expands the allowable range of the rib top width W1 and the number of ribs.

The influence of the tack also varies depending on the width of the adhesive film 2. Even in the adhesive film 2 having the same tack, decreasing the film width induces twisting to increase the risk of sticking or falling off. Further, decreasing the film width will decrease the unit area so that the influence of the tack relatively increases. Therefore, in an adhesive film, such as the adhesive film 2, in which the adhesive layer 12 is used after being released from the base film 11, it can be said that the influence of the tack is large. Although the present technology exhibits the effect regardless of the film width, the effect can be remarkably exhibited especially in the case where the film width is narrow (e.g., 0.6 mm or less, preferably 0.5 mm or less, more preferably 0.4 mm or less).

The tack of the adhesive layer 12 may be measured according to JIS Z 0237, or may be measured as a tack force by a probe method according to JIS Z 3284-3 or ASTM D 2979-01. For example, in a tack tester (TACII available from RHESCA), the adhesive layer 12 is placed on a receiving base of a silicon rubber of a sample base so that the measuring surface faces the probe surface. Then the measurement can be conducted by setting a (stainless mirror surface-finished) cylindrical probe of 5 mm diameter of the tack tester above the measuring surface, bringing the probe into contact with the measuring surface at a pressing speed of 30 mm/min, pressurizing the probe at a pressure of 196.25 gf and a pressurizing time of 1.0 sec, measuring the resistance received due to the adhesive force of the measuring surface when the probe is peeled off 2 mm from the measuring surface at a peeling speed of 120 mm/min as a load value, and determining the maximum load when the probe is peeled off from the measuring surface as the tack force (adhesive force). The number of measurements is preferably N=2 or more. The measuring temperature may be 23° C.+/−5° C.

The protrusion of the resin can be measured in accordance with Japanese Unexamined Patent Application Publication No. 2017-137188. The test may be performed under a test condition in which the resin is most likely to protrude, or under a test condition in which the resin is relatively less likely to protrude.

In a pull-out test of the adhesive film, the tape detachment rate of the adhesive film can be measured by using a pull-out tester Tensilon manufactured by A&D Company, Limited in accordance with Japanese Unexamined Patent Application Publication No. 2016-160027.

REFERENCE SIGNS LIST

1 reel member, 2 adhesive film, 3 winding core, 4 reel flange, 4*a* inner surface, 4*b* peripheral edge portion, 5 rib, 7 wound film, 10 adhesive film winding body, 11 base film, 12 adhesive layer

The invention claimed is:

1. A reel member, comprising:

a winding core around which an adhesive film is to be wound;

a pair of reel flanges provided on both sides of the winding core; and a plurality of ribs formed on an inner surface of at least one reel flange of the pair of reel flanges, protruding from the inner surface, and extending from a center side to a peripheral edge side of the at least one reel flange, wherein at least one rib of the plurality of ribs has a top portion and a base portion and a width of the top portion of the at least one rib in contact with the adhesive film is narrower than a width of the base portion of the at least one rib in contact with the inner surface in cross-sectional view, and wherein the at least one rib of the plurality of ribs extends to a position facing the winding core, and wherein the at least one rib comprises a section capable of facing the wound adhesive film and a section extending to a position facing the winding core, wherein a height and cross-sectional shape of the section capable of facing the wound adhesive film are different from a height and cross-sectional shape of the section extending to a position facing the winding core.

2. The reel member according to claim 1, wherein the at least one rib has a height greater than 0.01 mm and less than 0.1 mm.

3. The reel member according to claim 1, wherein the at least one rib has an inclined surface from the base portion to the top portion, and the inclined surface has an inclination angle of 2 to 45°.

4. The reel member according to claim 1, wherein the top portion of the at least one rib has a width of 0.10 mm to 0.80 mm.

5. The reel member according to claim 1, wherein a number of the ribs extending to the position facing the winding core is less than the total number of the ribs.

6. The reel member according to claim 1, wherein at least one of the reel flanges is transparent.

7. The reel member according to claim 1, wherein the reel member is prepared by steps comprising:

separately molding the winding core and each of the reel flanges; and attaching the reel flanges to the winding core.

8. The reel member according to claim 7, wherein the step of attaching comprises at least one selected from the group consisting of ultrasonic welding, impulse welding, the use of an adhesive and the use of an adhesive film.

9. The reel member according to claim 1, wherein (a) at least first one of the plurality of ribs extends only to a position facing the winding core and (b) at least second one of the plurality of ribs extends only to a position capable of facing the wound adhesive film, wherein a height and cross-sectional shape of the at least first one of the plurality of ribs (a) are different from a height and cross-sectional shape of the at least second one of the plurality of ribs (b).

10. The reel member according to claim 1, wherein the winding core comprises an insertion hole in a central portion thereof, wherein the insertion hole is configured such that a rotating device for driving the reel member may be inserted therein, and wherein none of the plurality of ribs extending to a position facing the winding core extend to the insertion hole.

11. The reel member according to claim 1, wherein the pair of reel flanges are formed in a disk shape, and wherein the at least one of the plurality of ribs extending to a position facing the winding core is a portion protruded from the inner surface of the at least one reel flange of the pair of reel flanges.

12. The reel member according to claim 1, wherein the adhesive film comprises a base film and an adhesive layer supported by the base film, and the base film and the adhesive layer are separable.

13. The reel member according to claim 1, wherein the winding core and at least one of the reel flanges are fixed by welding.

14. A method for manufacturing the reel member according to claim 1 comprising creating a first molded product comprising one reel flange in the pair of reel flanges and at least a part of the winding core;

creating a second molded product comprising an other reel flange in the pair of reel flanges; and combining the first and second molded products to form the reel member.

15. The method according to claim 14, wherein the step of combining the first and the second molded products comprises welding the first molded product to the second molded product.

16. A method of confirming in the reel member according to claim 1 a difference in the height and cross-sectional shape of the section capable of facing the wound adhesive film and the height and cross-sectional shape of the section extending to a position facing the winding core, comprising: applying a releasable liquid adhesive to the at least one reel flange, pressing a flat glass plate onto the releasable liquid adhesive, releasing the flat glass plate after curing, and then measuring a transferred product.

17. The method according to claim 16, wherein the at least one rib has a height greater than 0.01 mm and less than 0.1 mm.

18. The method according to claim 16, wherein the at least one rib has an inclined surface from the base portion to the top portion, and the inclined surface has an inclination angle of 2 to 45°.

19. The method according to claim 16, wherein the top portion of the at least one rib has a width of 0.10 mm to 0.80 mm.

20. An adhesive film winding body, comprising: a reel member comprising a winding core around which a tape-like adhesive film is to be wound, and a pair of reel flanges provided on both sides of the winding core; and a wound film formed by winding the tape-like adhesive film around the winding core, wherein the reel member is a reel member according to claim 1.

21. The adhesive film winding body according to claim 20, wherein the tape-like adhesive film has a width of 0.6 mm or less.

22. The adhesive film winding body according to claim 20, wherein the tape-like adhesive film is wound by 350 m or more.

23. The reel member according to claim 20, wherein the tape-like adhesive film comprises a base film and an adhesive layer supported by the base film, and the base film and the adhesive layer are separable.

* * * * *